US006272683B1

(12) United States Patent
Symms et al.

(10) Patent No.: US 6,272,683 B1
(45) Date of Patent: Aug. 14, 2001

(54) BUNTING FOR ATTACHMENT TO A SEAT

(76) Inventors: Tracy M. Symms; Steven S. Walbridge, both of 74 Charles St., Rochester, NH (US) 03867

( * ) Notice: Subject to any disclaimer, the term of this patent is extended or adjusted under 35 U.S.C. 154(b) by 0 days.

(21) Appl. No.: 09/732,413

(22) Filed: Dec. 7, 2000

(51) Int. Cl.[7] ..... A41D 1/00; A41B 13/06

(52) U.S. Cl. ..... 2/69.5; 2/75; 5/494; 5/655

(58) Field of Search ..... 2/69.5, 69, 75, 2/80, 83, 111, 84, 85, 93, 108; 5/655, 494, 94, 416, 413 R, 482; 297/184.13, 219.12, 184.11, 464, 465, 467, 256.15

(56) References Cited

U.S. PATENT DOCUMENTS

| | | | | |
|---|---|---|---|---|
| 3,962,738 | | 6/1976 | Menditto . | |
| 4,241,458 | | 12/1980 | Lesesne . | |
| 4,897,885 | | 2/1990 | Lunt . | |
| 4,901,371 | * | 2/1990 | Christians | 2/69.5 |
| 4,946,221 | * | 8/1990 | Livingston | 297/184 |
| 4,993,090 | * | 2/1991 | Ranalli | 5/482 |
| 5,243,724 | | 9/1993 | Barnes . | |
| 5,437,061 | | 8/1995 | Kenner . | |
| 5,611,095 | | 3/1997 | Schneider . | |
| 5,956,766 | | 9/1999 | Benway . | |
| 5,956,767 | * | 9/1999 | Imm | 2/69.5 |
| 5,988,742 | * | 11/1999 | Stevens | 2/69.5 |
| 6,012,189 | * | 1/2000 | Dudley | 5/655 |
| 6,036,260 | * | 3/2000 | Mullen | 2/69.5 |
| 6,055,686 | * | 5/2000 | Knight | 2/69.5 |
| 6,105,168 | * | 8/2000 | Hazen | 2/69.5 |

* cited by examiner

*Primary Examiner*—Amy B. Vanatta
(74) *Attorney, Agent, or Firm*—Joseph R. Birkner

(57) ABSTRACT

A bunting which attaches to a seat and a bunting that protects a child from the elements is disclosed. The bunting may be used on the seat of a stroller but not limited thereto. The bunting, fabricated from a material blank for wrapping about the child, has a draft shield attached to a first edge on a front of the material blank, a hood attached to a top edge of the material blank, a back having disposed thereon slots for receiving straps attached to the seat therethrough and means for fastening the first edge and a second edge of the material blank for closing the material blank about the child, such as a zipper. The zipper allowing partial access to the child when tending is necessary without the need to completely unzip the full length of the zipper thereby allowing the child to be tended without exposure to cold drafts when the child is in the seat without having to undo the straps and to completely open and to separate the material blank while selectively allowing the bunting to remain with the seat when the child is removed.

20 Claims, 3 Drawing Sheets

BUNTING FOR ATTACHMENT TO A SEAT

FIELD OF THE INVENTION

This invention relates generally to buntings or blankets for children. More particularly, the present invention relates to a bunting for use with seats such as the seats of strollers, carriages, bicycles, car seats, and other seats.

BACKGROUND OF THE INVENTION

Typically infants and young children are placed in seats of strollers or carriages for walking by their parents or guardians. Children also often ride in car seats and other vehicular seats as well as being placed in various types of non-vehicular seats. In cold or in inclement weather, children are wrapped in blankets or buntings prior to their outing and are then placed on the seat. Seats typically have various designs of three point or five point harnesses or straps such as a waist strap, a shoulder strap and a crotch strap attached thereto and a strap connector. Typically only the waist strap is fastened around the blanket in an attempt to securely hold the child in place. A problem is that a child wrapped in a blanket cannot be properly restrained because there is no convenient provision in the blanket for the crotch strap of the seat for adequately positioning between the child's legs whereby the child is inadequately held in place by only the waist strap. If the child is not securely fastened to the seat, the child can tumble out of the seat and become injured. Another problem is that the blanket cannot provide adequate body coverage for the child and can dislodge and may become entangled in the wheels of a vehicle such as a stroller and become soiled or damaged.

A practical bunting, for which there is an unfulfilled need, wherein the bunting capable of being selectively retained in a seat with either a three point harness or a five point harness so that the bunting remains in the seat after the child is removed and a bunting which permits the bunting to be opened without unstrapping the child or without unduly exposing the child to the elements and cold drafts, is not available.

U.S. Pat. No. 4,241,458 to Lesesne, shows a bunting for a seat with a drawstring hood with flaps and a drawstring on the bottom edge. A single zipper completely separates the bunting to access the interior. A disadvantage of this patent is that drawstrings can be dangerous for use with children who can become entangled in them and can be choked to death. Also, the single zipper which completely separates the bunting to access the interior unduly allows the child to be exposed to the elements and to cold drafts and also prevents partial tending to the child's lower body such as the legs, for example. Furthermore, no provision for or recognition of the need for shoulder straps is addressed, thereby making the design unsafe.

U.S. Pat. No. 5,437,061 to Kenner discloses a protective garment type of cover for carriages having arm openings and a music system similar, in some respects, to the previous mentioned design. A problem with Kenner's garment is that the provided arm openings expose a child's arms and hands to the elements. Also, Kenner's garment is designed to fit over handles of a carriage which makes it cumbersome to install as well as making it impractical for use on a seat with straps. Furthermore, the use of a music system adds to the cost of the design.

U.S. Pat. No. 5,956,766 to Benway discloses a stroller blanket, similar to the previous designs, which is attached to handles and to the frame of the stroller which is cumbersome to use, costly to manufacture and impractical for use independently without the stroller.

U.S. Pat. No. 3,962,738 to Menditto discloses a stroller blanket of a generally rectangular shape; U.S. Pat. No. 5,243,724 to Barnes discloses a multi-purpose baby wrap made from a full sized baby blanket; U.S. Pat. No. 5,611,095 to Schneider discloses a multi-function baby wrap and U.S. Pat. No. 4,897,885 to Lunt discloses a one-piece infant bunting with hook and loop fasteners.

None of the above prior art devices disclose a bunting for a seat with a draft shield and a bunting with a sealed bottom which does not completely separate and one which allows dual accessing of the child therein via a zipper means and a bunting which may be readily and selectively detachable from the seat and a bunting which is not necessarily associated with a seat and a bunting which is simple in design and is easy to use.

In view of the above mentioned problems and limitations associated with conventional bunting and blankets, it was recognized by the present inventors that there is an unfulfilled need for an improved bunting for attachment to a seat which is simple in design, practical, fun to use and is economically manufactured and which overcomes the disadvantages of the prior art devices.

SUMMARY OF THE INVENTION

It is therefore an object of this invention to provide a new and improved bunting which is conveniently usable with child seats having modern harnesses such as crotch straps, shoulder straps and waist straps which avoids the aforementioned problems of prior art devices.

It is an object of the instant invention to provide a bunting which may be manufactured from readily available materials by conventional manufacturing processes.

It is a further object of this invention to provide a bunting that is simple in design, simple to manufacture, low in cost and fun to use.

It is another object of this invention to provide a bunting which provides extensive freedom of movement to a child enveloped therein, from which the child may be readily removed.

It is a still a further object of this invention to provide a draft shield thereon the bunting.

It is a further object to provide means to readily open the bunting in order to tend to the child's needs or to remove the child therefrom.

It is a still a further object of this invention to provide a bunting which can be used independently of the seat to protect the child from the elements.

Further objects will become apparent from the following description and claims.

This invention results from the realization that there is a great need for an improved bunting. The resulting invention provides a user the capability of conveniently being able to have a child kept warm and safely positioned on a seat without the problem of the child falling out of the seat as well as the problem of separating the bunting and the risk of detaching it from the seat since the bunting may remain on the seat after the child is removed from the seat.

The above and the other objects are achieved in accordance with the present invention, which, according to a first aspect, provides a bunting which attaches to a seat such as, but not limited to, a stroller, and a bunting that protects a child from the elements. The bunting, fabricated from a material blank for wrapping about the child, has a front with a first edge and a second edge centrally disposed thereon; a back having disposed thereon a pair of first slots positioned near a top edge of the material blank for receiving a shoulder strap of the seat therethrough, a third slot positioned near a bottom edge of the material blank between the first pair of slots for receiving a crotch strap of the seat therethrough and a pair of second slots positioned between the first pair of slots and the third slot near a first side edge and a second side edge of the material blank for receiving a waist strap of the seat therethrough. A draft shield is attached to the first edge of the material blank and a hood is attached to the top edge of the material blank. Means for fastening the first edge and the second edge of the material blank for closing the material blank about the child are provided, such as a zipper. The zipper extends from the top edge to near the bottom edge of the material blank without extending beyond the bottom edge leaving the material blank intact and inseparable. The zipper has a pair of tabs which allows partial access to the child when tending is necessary without the need to completely unzip the full length of the zipper allowing the child to be tended without exposure to cold drafts when the child is in the seat without having to undo the straps and to completely open and to separate the material blank while selectively allowing the bunting to remain with the seat when the child is removed.

The second aspect is a special case of the first aspect of this invention with additional features. The draft shield extends from the top edge to near the bottom edge of the material blank and the draft shield is attached to the first edge of the material blank. The hood has an elastomeric member therein and the hood is attached to the top edge of the material blank.

According to a third aspect of the invention, disclosed is a method for making a bunting for attachment to a seat and for protecting a child from the elements.

According to a fourth aspect of the invention, disclosed is a method for using a bunting for attachment to a seat and for protecting a child from the elements.

DETAILED DESCRIPTION OF PREFERRED EMBODIMENTS

Figure 1:
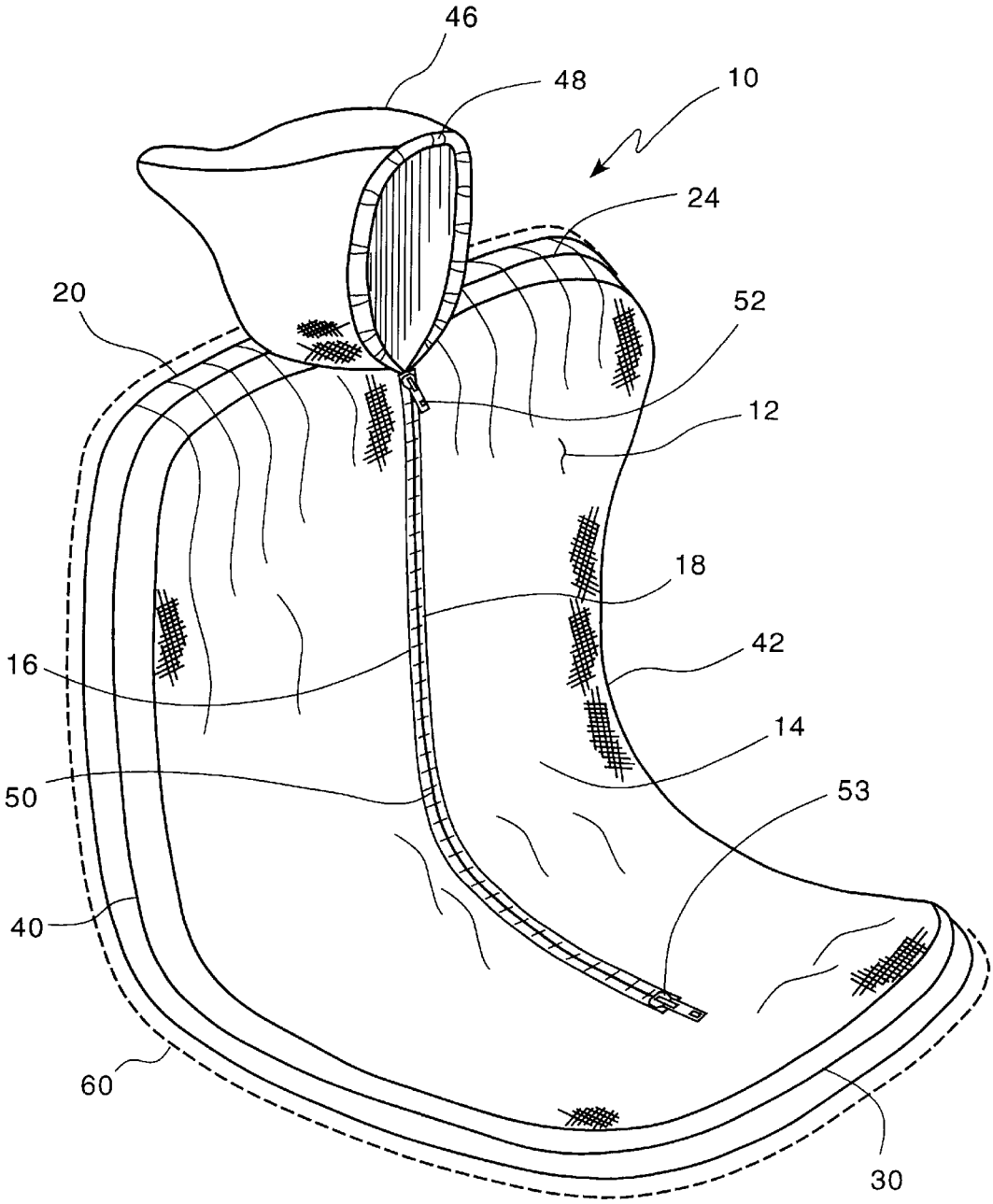
FIG. 1 is a perspective view of a preferred embodiment of a bunting for attachment to a seat of the instant invention shown with the bunting attached to the seat and with the seat shown in phantom.

Looking more particularly to the drawings, there is shown in FIG. 1 a preferred embodiment of a bunting which is generally indicated at 10, for attachment to a seat, according to a preferred embodiment of the present invention.

FIG. 1 is a perspective view of a preferred embodiment of the bunting 10 for attachment to a seat 60 showing the bunting 10 attached to the seat 60 which is shown in phantom. It is understood that the bunting 10 may be used with and adapted to practically any seat 60 for use with, but is not limited to, a stroller (not shown), and the bunting 10 protecting a child from the elements. The bunting 10, may, selectively remain in the seat 60 when the child is removed; alternately, the bunting 10 may be removed from the seat 60 and be independently usable without the seat 60 with the child disposed therein the bunting 10.

As seen in FIG. 1, the bunting 10, constructed from a material blank 12 for wrapping about the child, has fastening means in the preferred form of a zipper 50 centrally disposed on a front 14 and attached to a first edge 16 and to a second edge 18 of the material blank 12. The zipper 50 longitudinally extends from a top edge 24 to near a bottom edge 30 of the material blank 12 without extending beyond the bottom edge 30 thereby defining a sealed enclosure for receiving the child and leaving the material blank 12 intact and inseparable. The zipper 50 has a pair of tabs 52,53 which allows partial access to the child when tending is necessary without the need to completely unzip the full length of the zipper 50 allowing the child to be tended without exposure to cold drafts when the child is in the seat 60 without having to undo the straps or to completely open or to separate the material blank 12 while selectively allowing the bunting 10 to remain with the seat 60 when the child is removed. Preferably, a hood 46 may be attached to the top edge 24 of the material blank 12. The hood 46 may have an elastomeric portion 48 therein to snugly fit about the head of the child. The bunting 10 has a draft shield 44, attached to the first edge 16 of the material blank 12, best seen in FIG. 3, to prevent the child from being exposed to the elements, particularly to cold drafts when the zipper 50 is opened. The bunting 10 has openings in the form of slots formed in a back 20 of the material blank 12 as best seen in FIG. 2 for receiving a body harness in the form of straps attached to the seat 60 and passing therethrough the slots, for restraining the child.

Figure 2:
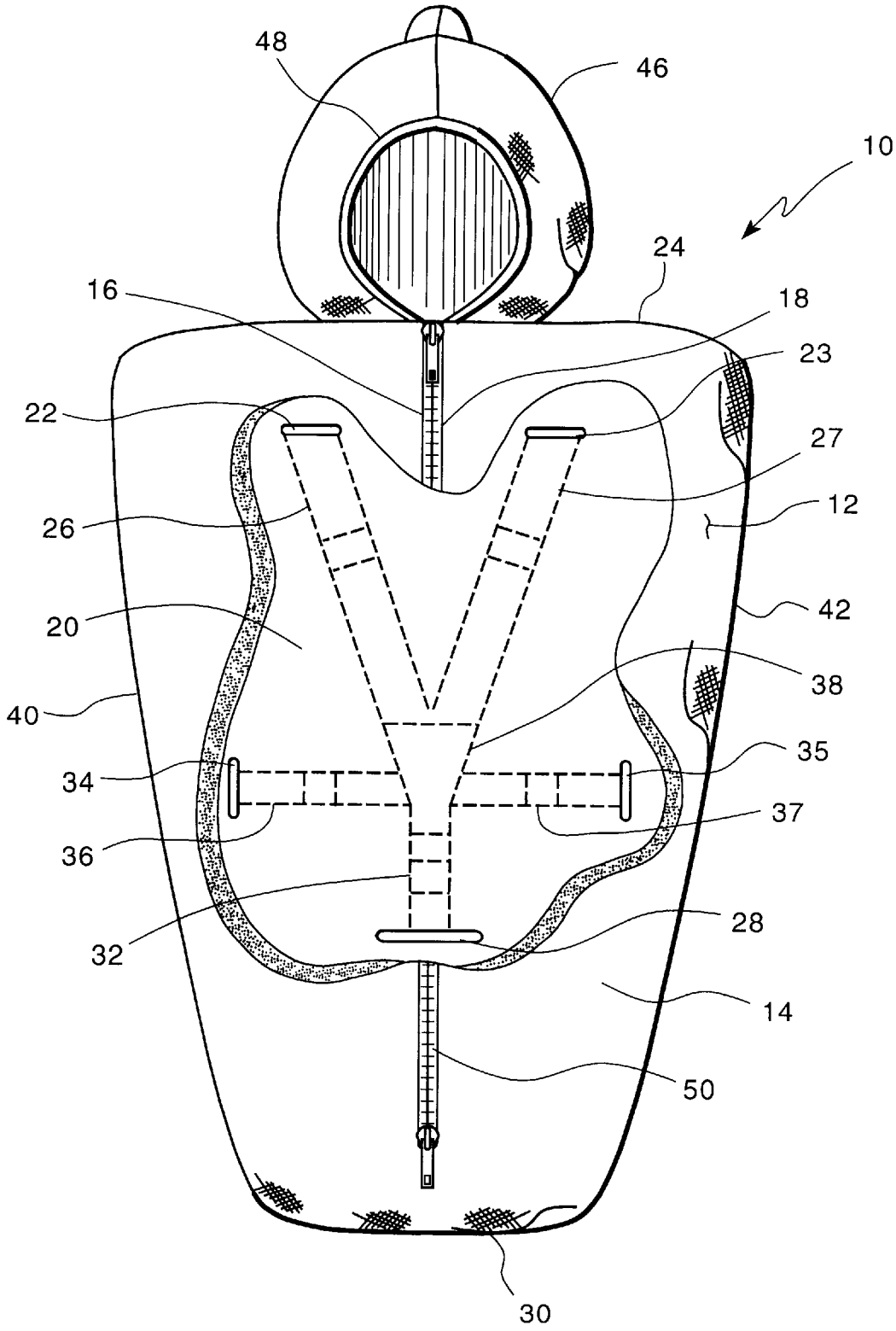
FIG. 2 is a front partial cutaway view of the bunting of FIG. 1 showing a pair of first slots, a third slot and a pair of second slots with a shoulder strap, a waist strap, a crotch strap passing therethrough the slots in a back of a material blank of the bunting and a strap connector with the straps and the strap connector each shown in phantom.

FIG. 2 is a front partial cutaway view of the bunting 10 of FIG. 1. The back 20 of the material blank 12, having disposed thereon, a pair of first slots 22, 23, positioned near the top edge 24 of the material blank 12 for receiving a shoulder strap 26,27 of the seat 60 therethrough, a third slot 28 positioned near the bottom edge 30 of the material blank 12 between the first pair of slots 22,23 for receiving a crotch strap 32 of the seat 60 therethrough and a pair of second slots 34,35 positioned between the first pair of slots 22,23 and the third slot 28 near a first side edge 40 and a second side edge 42 of the material blank 12 for receiving a waist strap 36,37 of the seat 60 therethrough. The pair of first slots 22,23 and the third slot 28 of the material blank 12 are horizontal with respect to the top edge 24 and to the bottom edge 30 of the material blank 12. The pair of second slots 34,35 of the material blank 12 are vertical with respect to the pair of first slots 22,23 and to the third slot 28 of the material blank 12. The third slot 28 of the material blank 12 is longer than each of the pair of first slots 22,23 and the pair of second slots 34,35 to receive a strap connector 38 therethrough.

A typical five point harness is shown in FIG. 2 with the shoulder strap 26,27, the waist strap 36,37 and the crotch strap 32 which pass therethrough the above mentioned slots and are connected to the strap connector 38. The above straps and the strap connector 38 each being shown in phantom. It is understood that various styles of straps and strap connectors may be readily adapted for use including a three point harness without departing from this disclosure. Also, a user may own two or more different strollers, for example. Additional slots may be provided in the back 20 of the material blank 12 for use with multiple strollers having different strap mounting configurations thereby requiring additional slots (not shown) for such applications.

Figure 3:
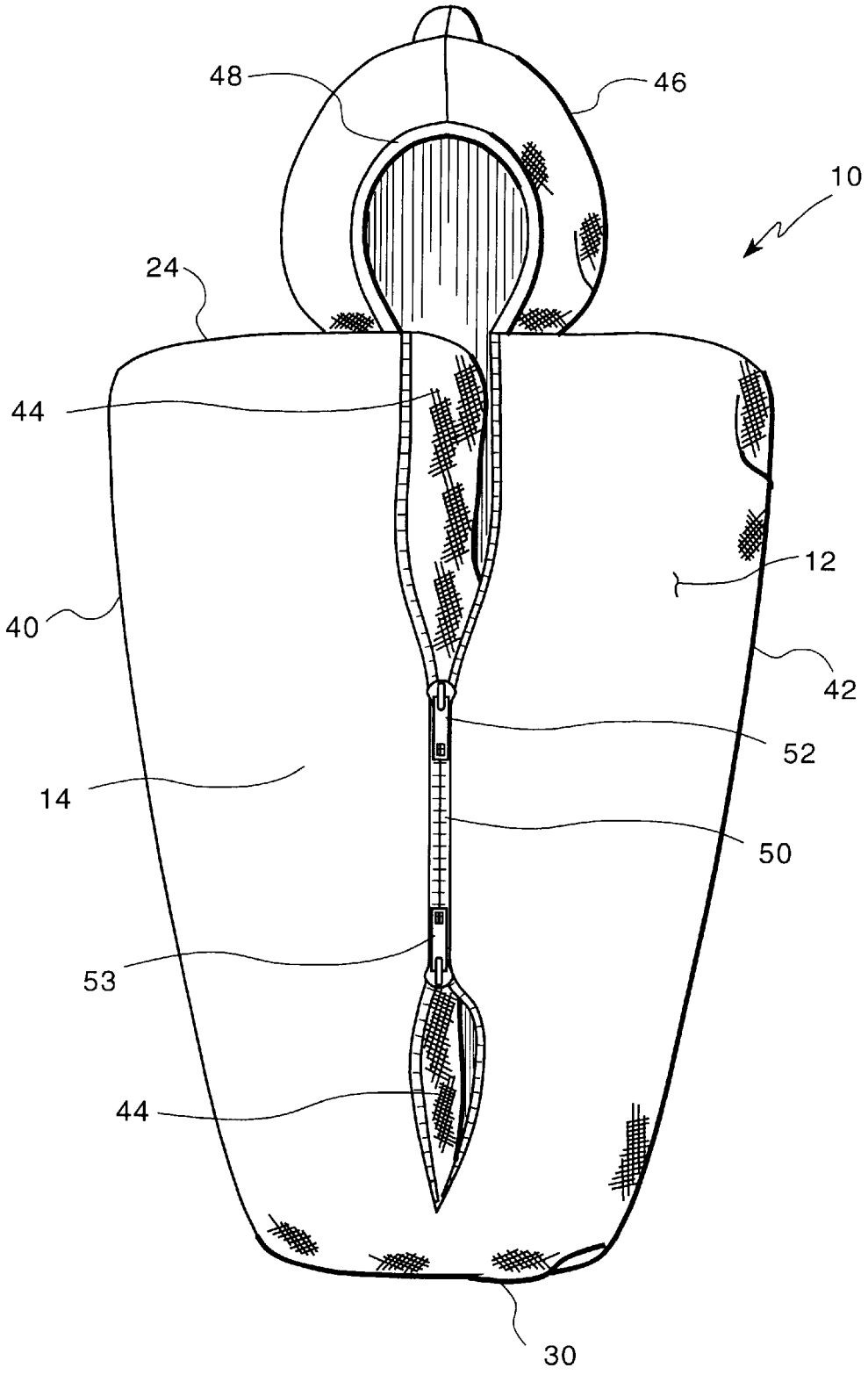
FIG. 3 is a front view of a preferred embodiment of the bunting of FIG. 1 showing a draft shield when a zipper is in a partially opened position.

FIG. 3 is a front view of a preferred embodiment of the bunting 10 of FIG. 1 showing the draft shield 44 when the zipper 50 is partially unzipped with tabs 52,53.

The bunting 10 may be fabricated from readily available materials and by conventional fabrication techniques such as sewing. For example, the material blank 12, from which the bunting 10 may be made, is a material chosen from the group a material consisting of fleece, wool, flannel and cotton. The material may also be one of which is quilted, insulated, lined and be decorative as well as being water proof. The bunting 10 may be dimensioned for use with a particular type of seat 60 as well as for the age and physical size of a particular child. Also, the material blank 12 of the bunting 10 may be tapered. The back 20 of the material blank 12 may be suitably adapted for and sized with strategically placed slots to receive seat straps corresponding to a specific seat design for a given application such as for use with various styles of strollers, carriages, bicycles, car seats, wagons, boats, aircraft and other vehicular seats as well as non-vehicular seats such as stadium seats, benches, chairs and swings.

To use the bunting 10, a user simply places the bunting 10 on the seat 60 which has straps thereon which pass through the back 20 of the material blank 12 of the bunting 10. The child is placed into the bunting 10 and the straps are secured about the torso of the child, with the child's arms and legs being inside the bunting 10. The zipper 50 is closed and the hood 46 is placed about the child's head with the elastomeric member 48 snugly fitting about the child's head thereby keeping the child warm and secured to the seat 60 of a vehicle such as the stroller. When the child must be tended, the zipper 50 may be selectively and partially unzipped with the tabs 52,53 and the draft shield 44 further protecting the child from cold drafts. The child may be readily removed from the bunting 10 while the bunting 10 may remain in the seat 60 after the child is removed for subsequent use. Alternately, the child may be first placed into the bunting 10 prior to placement in the seat 60 and then the zipper 50 may be opened so that the straps from the seat 60 may then be secured about the child's torso and then the zipper 50 be closed in a manner discussed above. Furthermore, the bunting 10 may also be used independently of the seat 60 and the child may be carried while enclosed in the bunting 10.

Surprisingly, the instant invention provides an added advantage and recognizes a problem and adequately and completely addresses an unfulfilled need, in that the bunting 10, in the manner disclosed, in effect, provides a convenient apparatus which allows a child to be securely protected from the elements and from cold drafts and provides the desired above mentioned advantages and benefits to a user.

It is understood that the bunting 10 may be constructed in a wide variety of sizes, colors and style variations. The bunting 10 can also be used on a wide variety of seats in the manner as described above. One practical advantage of the invention is that it provides a convenient, practical, low cost, bunting 10, which allows a user to conveniently protect a child from the elements and to safely secure the child to a seat 60 of a vehicle. A further advantage of the invention is that the bunting 10 is designed for ease of manufacture by standard methods and by using readily available materials.

Of course, a wide variety of further uses and advantages of the present invention will become apparent to one skilled in the art. Also, one skilled in the art will realize that the foregoing discussion outlines the more important features of the invention to enable a better understanding of the instant invention and to instill a better appreciation of the inventors' contribution to the art. It must be clear that the disclosed details of construction, descriptions of geometry and illustrations of inventive concepts are mere examples of possible manifestations of the invention.

Although the invention has been shown and described with reference to certain preferred embodiments, those skilled in the art undoubtedly will find alternative embodiments obvious after reading this disclosure. With this in mind, the following claims are intended to define the scope of protection to be afforded the inventor, and those claims shall be deemed to include equivalent constructions insofar as they do not depart from the spirit and scope of the present invention.

What is claimed:

1. A bunting for attachment to a seat and for protecting a child from the elements, said bunting comprising:

a material blank, for wrapping about the child;

said material blank having a front with a first edge and a second edge centrally disposed thereon; a back having disposed thereon a pair of first slots positioned near a top edge of said material blank for receiving a shoulder strap of the seat therethrough, a third slot positioned near a bottom edge of said material blank between the first pair of slots for receiving a crotch strap of the seat therethrough and a pair of second slots positioned between the first pair of slots and the third slot near a first side edge and a second side edge of said material blank for receiving a waist strap of the seat therethrough;

a draft shield attached to said first edge of said material blank;

a hood attached to said top edge of said material blank; and means for fastening said first edge and said second edge of said material blank for closing said material blank about the child whereby said fastening means allowing the child to be tended without exposure to cold drafts when the child is in the seat without having to undo the straps and to completely open and to separate said material blank while selectively allowing said bunting to remain with the seat when the child is removed.

2. The bunting of claim 1 wherein said fastening means is a zipper.

3. The bunting of claim 2 wherein said zipper extends from said top edge to near said bottom edge of said material blank without extending beyond said bottom edge leaving said material blank intact and inseparable.

4. The bunting of claim 3 wherein said zipper has a pair of tabs which allows partial access to the child when tending is necessary without the need to completely unzip the full length of said zipper.

5. The bunting of claim 4 wherein said draft shield extends from said top edge to near said bottom edge of said material blank.

6. The bunting of claim 5 wherein said hood has an elastomeric member therein.

7. The bunting of claim 6 wherein said bunting is fabricated from a material chosen from the group consisting of fleece, wool, flannel and cotton.

8. The bunting of claim 7 wherein said bunting is fabricated from said material blank by sewing.

9. The bunting of claim 8 wherein said material blank is tapered.

10. The bunting of claim 9 wherein the pair of first slots and the third slot of said material blank are horizontal with respect to said top edge and said bottom edge of said material blank.

11. The bunting of claim 10 wherein the pair of second slots of said material blank are vertical with respect to the pair of first slots and the third slot of said material blank.

12. The bunting of claim 11 wherein the third slot of said material blank is longer than each of the pair of first slots and the pair of second slots to receive a strap connector therethrough.

13. A bunting for attachment to a seat and for protecting a child from the elements, said bunting comprising:

a material blank, for wrapping about the child;

said material blank having a front with a first edge and a second edge centrally disposed thereon; a back having disposed thereon a pair of first slots positioned near a top edge of said material blank for receiving a shoulder strap of the seat therethrough, a third slot positioned near a bottom edge of said material blank between the first pair of slots for receiving a crotch strap of the seat therethrough and a pair of second slots positioned between the first pair of slots and the third slot near a first side edge and a second side edge of said material blank for receiving a waist strap of the seat therethrough;

a draft shield extending from said top edge to near said bottom edge of said material blank;

said draft shield attached to said first edge of said material blank;

a hood having an elastomeric member therein;

said hood attached to said top edge of said material blank; and means for fastening said first edge and said second edge of said material blank for closing said material blank about the child whereby when said bunting is placed on the seat and the child is placed into the bunting and the seat straps passing through said bunting are secured about the child, the child being safely secured to the seat and protected from the elements and said fastening means allowing the child to be tended without exposure to cold drafts when the child is in the seat without having to undo the straps and to completely open and to separate said bunting while selectively allowing said bunting to remain with the seat when the child is removed.

14. The bunting of claim 13 wherein said bunting is fabricated from a material chosen from the group consisting of fleece, wool, flannel and cotton.

15. The bunting of claim 14 wherein said fastening means is a zipper wherein said zipper extends from said top edge to near said bottom edge of said material blank without extending beyond said bottom edge leaving said material blank intact and inseparable.

16. The bunting of claim 15 wherein said zipper has a pair of tabs which allows partial access to the child when tending is necessary without the need to completely unzip the full length of said zipper.

17. A method for making a bunting for attachment to a seat and for protecting a child from the elements, comprising the steps of:

providing a material blank for wrapping about the child with a front having a first edge and a second edge centrally disposed thereon and a back;

forming in said back, a pair of first slots positioned near a top edge of said material blank for receiving a shoulder strap of the seat therethrough, a third slot positioned near a bottom edge of said material blank between the first pair of slots for receiving a crotch strap of the seat therethrough and a pair of second slots positioned between the first pair of slots and the third slot near a first side edge and a second side edge of said material blank for receiving a waist strap of the seat therethrough;

forming a draft shield in said front of said material blank;

attaching said draft shield to said first edge of said material blank;

providing a hood having an elastomeric member therein;

attaching said hood to said top edge of said material blank;

joining said front of said material blank to said back; and providing means for fastening said first edge and said second edge of said material blank for closing said material blank about the child.

18. The method for making a bunting of claim 17 wherein the step of joining said front of said material blank to said back is achieved by sewing.

19. The method for making a bunting of claim 18 wherein the step of providing said fastening means for closing said material blank about the child is achieved by a zipper.

20. A method for using a bunting formed from a material blank having a draft shield attached to a first edge, fastening means attached to said first edge and to a second edge of a front of said material blank, a hood attached to a top edge of said material blank and a back joined to said front with said back having slots therein for receiving therethrough, a shoulder strap, a crotch strap, a waist strap and a strap connector which are attached to the seat; said bunting for attachment to a seat and for protecting a child from the elements, comprising the steps of:

positioning said bunting on the seat;

placing the child into said bunting;

passing the shoulder strap, the crotch strap, the waist strap and the strap connector each therethrough said bunting;

placing the shoulder strap, the crotch strap and the waist strap about the child;

securing the shoulder strap, the crotch strap and the waist strap to the strap connector; and, closing said bunting about the child with said fastening means whereby the child is safely secured to the seat and is protected from cold drafts and from the elements while allowing the child to be tended without exposure to cold drafts when the child is in the seat without having to undo the straps and to completely open and to separate said bunting while selectively allowing said bunting to remain with the seat when the child is removed.

* * * * *